United States Patent [19]

Hofmann

[11] 4,296,887

[45] Oct. 27, 1981

[54] HEAT PROTECTED FUEL INJECTION PLUG FOR INTERNAL COMBUSTION ENGINES

[75] Inventor: Karl Hofmann, Remseck, Fed. Rep. of Germany

[73] Assignee: Robert Bosch GmbH, Stuttgart, Fed. Rep. of Germany

[21] Appl. No.: 75,907

[22] Filed: Sep. 17, 1979

[30] Foreign Application Priority Data

Sep. 15, 1978 [DE] Fed. Rep. of Germany ... 7827497[U]

[51] Int. Cl.[3] ..... F02N 61/14

[52] U.S. Cl. ..... 239/397.5; 123/271; 277/110; 239/533.2

[58] Field of Search ..... 123/32 JV, 32 H, 32 R, 123/139 AW; 239/533.1–533.12, 397.5; 277/110

[56] References Cited

U.S. PATENT DOCUMENTS

| | | | |
|---|---|---|---|
| 599,852 | 3/1898 | Lufkin | 277/110 |
| 2,097,713 | 11/1937 | Ashley | 277/110 |
| 2,144,874 | 1/1939 | Edwards | 239/533.4 |
| 2,168,839 | 8/1939 | Edwards | 239/533.4 |
| 2,247,031 | 6/1941 | Norton | 277/110 |
| 3,038,456 | 6/1962 | Dreisin | 123/32 R |
| 3,695,235 | 10/1972 | Anderson | 239/533.3 |
| 3,841,277 | 10/1974 | Schäfer | 123/32 JV |

*Primary Examiner*—Charles J. Myhre
*Assistant Examiner*—Raymond A. Nelli
*Attorney, Agent, or Firm*—Frishauf, Holtz, Goodman & Woodward

[57] ABSTRACT

A heat protecting sleeve or bushing surrounds the terminal end of the fuel injection plug and is formed with an inturned, inwardly directed lip which resiliently bears against the end face surface of the fuel injection plug, in a slightly funnel-shaped arrangement to permit tightening of the plug within the respective matching bore opening of the cylinder head while compensating for tolerances in manufacture, and yet provide for resilient sealing engagement of the inwardly directed funnel-shaped flange forming the sealing lip against the end face surface of the plug.

4 Claims, 2 Drawing Figures

HEAT PROTECTED FUEL INJECTION PLUG FOR INTERNAL COMBUSTION ENGINES

Figure 1:
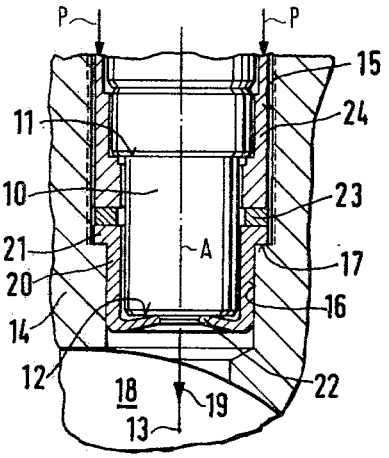

The present invention relates to fuel injection plugs for an internal combustion engine, for example of the Diesel type, and more particularly to a heat protection construction to protect the injection area or injection zone of the plug against ambient heat in the combustion space of the engine.

BACKGROUND AND PRIOR ART

Fuel injection plugs for Diesel engines are commonly screwed into the cylinder block. The plugs are formed with a flange or a shoulder which engages a matching shoulder or offset in the cylinder block. It has previously been proposed to provide a heat protecting sleeve which is supported with a flange on a shoulder of the support element, typically the cylinder block, of the fuel injection plug, and which clamps a heat protective ring between the plug and a ring-shaped sealing lip on the sleeve. The heat protective ring is necessary for proper operation of the entire assembly, and particularly for the sleeve.

It has also been proposed to provide heat protection for fuel injection plugs by locating a heat protecting disk with a ring-shaped sealing lip instead of the sleeve or bushing. The bottom of the plug engages the sealing lip and a clamping nut holds the protective disk pressed against a shoulder of the holder for the plug, for example the cylinder block.

THE INVENTION

It is an object to provide a fuel injection plug arrangement in which the dimensions of the plug and heat protecting assembly can be reduced, and in which larger manufacturing tolerances can be accepted than heretofore possible.

Briefly, the heat protection construction, in accordance with the invention, includes a bushing which surrounds the fuel injection plug structure in the region of the injection end thereof, the bushing being formed with an external flange fitting against a mating seat formed in the opening of the cylinder block, and with a terminal sealing lip which is formed as an in-turned inwardly directed flange, partly overlapping the terminal end face surface of the plug structure. Preferably, the in-turned flange of the heat protecting bushing has a cylindrical portion which extends slightly beyond the terminal end face surface of the plug at the circumferential walls thereof, the inwardly directed flange having a central portion resiliently bearing against the end face surface in the vicinity of the center of the plug to form a slightly funnel-shaped or tapering end portion, resiliently bearing against the end face surface. In assembly, the sealing lip, formed by the inwardly directed flange, can be plastically heat-deformed, without, however, stressing it beyond its elastic limits so that the remaining elastic deformation ensures the sealing function thereof while, on the other hand, permitting bridging of manufacturing tolerances.

The arrangement has the specific advantage, with respect to heat protected plugs in accordance with the prior art, that the outer diameter of the heat protecting sleeve, as well as the distance of the injection plug to the combustion chamber itself, can be reduced. No specific separate heat protecting ring is necessary, so that manufacture as well as assembly costs can be reduced.

Figure 2:
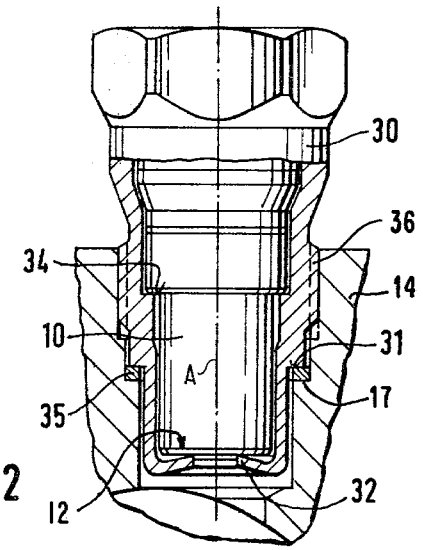

Drawings, illustrating preferred examples, wherein:

FIG. 1 is a fragmentary axial view, partly in section, of a fuel injection plug with a heat protecting sleeve; and and FIG. 2 shows an integral plug-and-sleeve combination, largely in cross section.

The fuel injection plug 10 (FIG. 1), itself, preferably made of steel, can be made in accordance with any suitable construction. It is, essentially, a cylindrical body, symmetrical with respect to a vertical (with respect to FIG. 1) axis of rotation 13. The plug 10 is formed with a stepped shoulder 11. It has an end face surface 12 which extends at right angles to the central axis of rotation A. A fuel injection duct terminates in an injection opening formed in the bottom face surface 12. The duct and the opening are not shown for simplicity of the drawing, and can be in accordance with any well known construction. The plug is secured in the cylinder head 14 of a Diesel-type internal combustion engine. The cylinder head 14 has a stepped bore therein, having a first bore opening 15, of wider diameter, and a second bore opening 16 narrower than bore 15; the bore opening 16 terminates in a ring-shaped flat shoulder 17, from which the bore 15 extends. The direction of fuel injection is shown by arrow 19. The second bore opening 16 terminates in the combustion chamber 18 of the internal combustion (IC) engine. The heat protective element comprises a sleeve or bushing 20 made of steel. Bushing 20, at one end, has an externally directed flange 21 and at the other end an internally directed, circular sealing lip 22, shaped in form of an internally directed flange. The sealing lip 22 is slightly funnel-shaped or tapered. FIG. 1 illustrates the plug 10 and the heat protecting bushing 20 in sealing and in operating condition. The end face surface 12 of plug 10 engages the sealing lip 22 of the heat protecting bushing 20. The flange 21 of bushing 20 is engaged on the shoulder 17 of the cylinder head 14. A clamping nut 24, cooperating with the step or offset 11, is screwed into the cylinder head 24. Upon tightening the clamping nut 24, in the direction of the arrows P, for example by threading into the block 14, the end face 12 of the plug 10 will press against the sealing lip 22. Clamping nut 24, upon tightening, further will press against a sealing ring 23, for example made of copper, which is placed between the outwardly directed flange 21 of the sleeve or bushing 20 and nut 24. The lower surface—FIG. 1—of the outwardly directed flange 24 will engage the shoulder 17 in the cylinder block 14.

FIG. 2 illustrates another embodiment. A fuel injection plug 10 is placed in a heat protective sleeve or bushing 30 which is unitary with the attachment element to secure it into the cylinder block. Bushing 30 is a unitary sleeve-and-clamping element which has an outer sealing sleeve formed with in-turned sealing lips 32 which, as in the embodiment of FIG. 1, are slightly funnel-shaped. The outer end walls of the sealing sleeve extend slightly beyond the end walls of the injection plug itself and then taper inwardly towards a central region thereof, as clearly seen in the drawings. A shoulder 31 of the unitary bushing 30 fits against a copper sealing ring 35 which, in turn, is seated on a shoulder of the cylinder head. A shoulder 34 is provided to position and support the fuel injection plug 10 itself. The bushing 30 is formed with a hexagonal nut portion for engagement with a wrench, so that the entire assembly can be screwed into a suitable opening, threaded as seen at 36 (FIG. 2) in the cylinder head 14 of the IC engine.

Various changes and modifications may be made within the scope of the inventive concept.

I claim:

1. Heat protection construction for a fuel injection plug (10), adapted for insertion into an opening (15, 16) in the cylinder block (14) of a Diesel internal combustion (IC) engine, wherein the plug has an end surface (12) facing the combustion chamber of the engine and a fuel injection opening formed in said end surface;

and comprising a bushing (20, 30) surrounding the plug in the region of the injection opening thereof, said bushing integrally including, in accordance with the invention, an external flange (21, 31) fitting against a matching seat (17) formed in the opening (15, 16) of the cylinder block, and a resiliently deformable terminal sealing lip (22, 32) integrally connected with said external flange and formed as an in-turned inwardly directed resilient flange portion overlapping a portion of the terminal end face surface (12) of the plug (10) and in resilient sealing and heat protecting engagement with said terminal end face surface.

2. Construction according to claim 1, wherein the bushing (30) is a unitary threaded compression element.

3. Construction according to claim 1, further including a threaded compression nut (24) secured in the cylinder block and positioned to apply a compressive force against the external flange (21) of the bushing (20);

and a sealing ring (23) interposed between the clamping nut and said flange (21).

4. Construction according to claim 1 or 2 or 3, wherein the bushing comprises a cylindrical portion extending slightly beyond said end face surface (12) of the plug (10) at circumferential walls thereof and having central portions, forming said in-turned flange portion, bearing against said end face surface in the vicinity of the center of the plug to form a funnel-shaped or tapered end portion resiliently bearing against said end face surface (12).

* * * * *